US011980800B2

(12) United States Patent
He et al.

(10) Patent No.: US 11,980,800 B2
(45) Date of Patent: May 14, 2024

(54) HYDRAULIC DAMPING DEVICE WITH ADJUSTABLE RESISTANCE AND A RIDING PLATFORM

(71) Applicant: SHENZHEN THOUSANDSHORES TECHNOLOGY CO., LTD., Shenzhen (CN)

(72) Inventors: Ding He, Shenzhen (CN); Zhi Liu, Shenzhen (CN); Xin Li, Shenzhen (CN)

( * ) Notice: Subject to any disclaimer, the term of this patent is extended or adjusted under 35 U.S.C. 154(b) by 158 days.

(21) Appl. No.: 17/707,381

(22) Filed: Mar. 29, 2022

(65) Prior Publication Data

US 2023/0140915 A1 May 11, 2023

(30) Foreign Application Priority Data

Nov. 8, 2021 (CN) ..... 202111316012.1

(51) Int. Cl.
*A63B 69/16* (2006.01)
*A63B 21/008* (2006.01)
*A63B 21/22* (2006.01)

(52) U.S. Cl.
CPC ..... *A63B 69/16* (2013.01); *A63B 21/008* (2013.01); *A63B 21/22* (2013.01); *A63B 2069/164* (2013.01)

(58) Field of Classification Search
CPC .. A63B 21/008; A63B 21/0084–00845; A63B 21/0085; A63B 21/0088; A63B 21/22; A63B 69/16–2069/168
See application file for complete search history.

(56) References Cited

U.S. PATENT DOCUMENTS 7,955,227 B2 * 6/2011 Chen ..... A63B 69/16 482/61
2005/0272579 A1 * 12/2005 Wang ..... A63B 21/00069 482/127
2018/0135655 A1 * 5/2018 Chen ..... F04D 29/4213

* cited by examiner

*Primary Examiner* — Jennifer Robertson

(57) ABSTRACT

Disclosed is a hydraulic damping device with adjustable resistance and a riding platform. The hydraulic damping device with adjustable resistance comprises a support frame, a rotating mechanism movably connected to the support frame, a hydraulic damping mechanism arranged at one end of the rotating mechanism and an inertia wheel detachably connected to an other end of the rotating mechanism, and the hydraulic damping mechanism comprises a shell and a rotating disc connected with the rotating mechanism extending into the shell, at least one blade is arranged on the rotating disc, and the blade is connected with the rotating disc in an adjustable angle to provide resistance at a corresponding angle. The angle of the blade relative to the rotating disc is adjusted so that when the blade rotates with the rotating disc, different from the resistance generated by the damping liquid in the shell, different resistance effects are provided.

9 Claims, 6 Drawing Sheets

HYDRAULIC DAMPING DEVICE WITH ADJUSTABLE RESISTANCE AND A RIDING PLATFORM

CROSS-REFERENCE TO RELATED APPLICATIONS

This application claims priority to Chinese Patent Application No. 202111316012.1, filed on Nov. 8, 2021. The content of all of which is incorporate herein by reference.

FIELD OF THE INVENTION

The present disclosure relates to the mechanical field, in particular to a hydraulic damping device with adjustable resistance and a riding platform.

BACKGROUND

Damping device is a device that provides motion resistance and consumes motion capacity. With the development of science and technology, the damping device has been widely used in various fields. For example, it can be used in aviation, aerospace, ships, guns and other devices in military industry, and in civil fields, the damping device can be used in automobile, construction, fitness equipment and other fields.

There are three types of damping devices in the prior art, namely, liquid damping device, gas damping device and electromagnetic damping device. The liquid damping device mainly uses the resistance of damping liquid to consume external force, which can provide smooth resistance effect without energy consumption, and provide green and environmental protection. The liquid damping device is increasingly favored by various fields, especially in the field of fitness equipment. However, the disadvantage of the current liquid damping device is that an output resistance is fixed and cannot be adjusted. For example, in current popular riding platform, the liquid damping device is connected with the riding device for users to obtain the resistance through riding, so as to achieve realistic riding effect or training effect. Because the resistance of the liquid damping device is unadjustable, when people ride at the same speed, the resistance obtained is fixed. In this case, the riding platform in the gym is mainly used for people with good physical quality, but for children, the elderly and those with weaker physical quality compared with the middle-aged, the low resistance when riding, the fast and realistic riding feeling are impossible to experience, which makes the experience feels boring.

Therefore, the existing technology needs to be improved and developed.

BRIEF SUMMARY OF THE DISCLOSURE

In view of the shortcomings of the above prior art, the purpose of the present disclosure is to provide a hydraulic damping device with adjustable resistance and a riding platform, and to solve the problem that the resistance of the hydraulic damping device cannot be adjusted in the prior art.

The technical scheme of the present disclosure is as follows:

A hydraulic damping device with adjustable resistance, includes a support frame, a rotating mechanism movably connected to the support frame, a hydraulic damping mechanism arranged at one end of the rotating mechanism and an inertia wheel detachably connected to another end of the rotating mechanism, wherein the hydraulic damping mechanism includes:

a shell;

a rotating disc connected with the rotating mechanism extending into the shell, at least one blade is arranged on the rotating disc, and the blade is connected with the rotating disc in an adjustable angle to provide resistance at a corresponding angle.

The hydraulic damping device with adjustable resistance further includes:

a steering wheel arranged at a position corresponding to the rotating disk in the shell, and a slide path is arranged at a position corresponding to a slide rail of the blade;

a steering rod connected with the rotating disc to control the resistance through the steering rod.

In the hydraulic damping device with adjustable resistance, the rotating disc is provided with a fan-shaped through hole, and the blade is arranged in the fan-shaped through hole.

In the hydraulic damping device with adjustable resistance, the slide path is an arc-shaped through hole and the slide path is a first positioning column.

In the hydraulic damping device with adjustable resistance, a cavity is arranged in the rotating mechanism, and the steering rod extends to the other end of the rotating mechanism through the cavity.

In the hydraulic damping device with adjustable resistance, a rotating button is also included, the rotating button is connected with the steering rod, a groove is arranged on the inertia wheel corresponding to a position of the rotating button, and the rotating button is clamped in the groove.

In the hydraulic damping device with adjustable resistance, a resistance sleeve is detachably connected in the shell, and a resistance rib is arranged on an inner side of the resistance sleeve.

In the hydraulic damping device with adjustable resistance, an opening is arranged on one side of the support frame corresponding to the rotating mechanism.

The present disclosure also provide a riding platform with the hydraulic damping device with adjustable resistance as described above.

Beneficial effects: the present disclosure discloses a liquid damping device with adjustable resistance and a riding platform. The liquid damping device with adjustable resistance comprises a support frame, a rotating mechanism, a liquid damping mechanism and an inertia wheel. The rotating mechanism is movably connected with the support frame, and the liquid damping mechanism is arranged at one end of the connecting mechanism, the inertia wheel is arranged at the other end of the connecting mechanism. The liquid damping mechanism also comprises a shell and a rotating disc, the rotating disc is connected with the rotating mechanism extending into the shell, at least one blade is also arranged on the rotating disc, and the blade is connected with the rotating disc in an adjustable angle to realize that the rotating disc provides resistance for the hydraulic damping mechanism when driving the blade to rotate. The present disclosure adjusts the angle of the blade relative to the rotating disc, so that when the blade rotates with the rotating disc, different from the resistance generated by the damping liquid in the shell, different resistance effects are provided for the liquid damping device.

DETAILED DESCRIPTION OF EMBODIMENTS

In order to make the purpose, technical scheme and effect of the present disclosure clear and definite, the present disclosure is further described in detail with reference to the attached drawings and embodiments. It should be understood that the embodiments described herein are only used to explain the present disclosure and are not used to limit the present disclosure.

Figure 1:
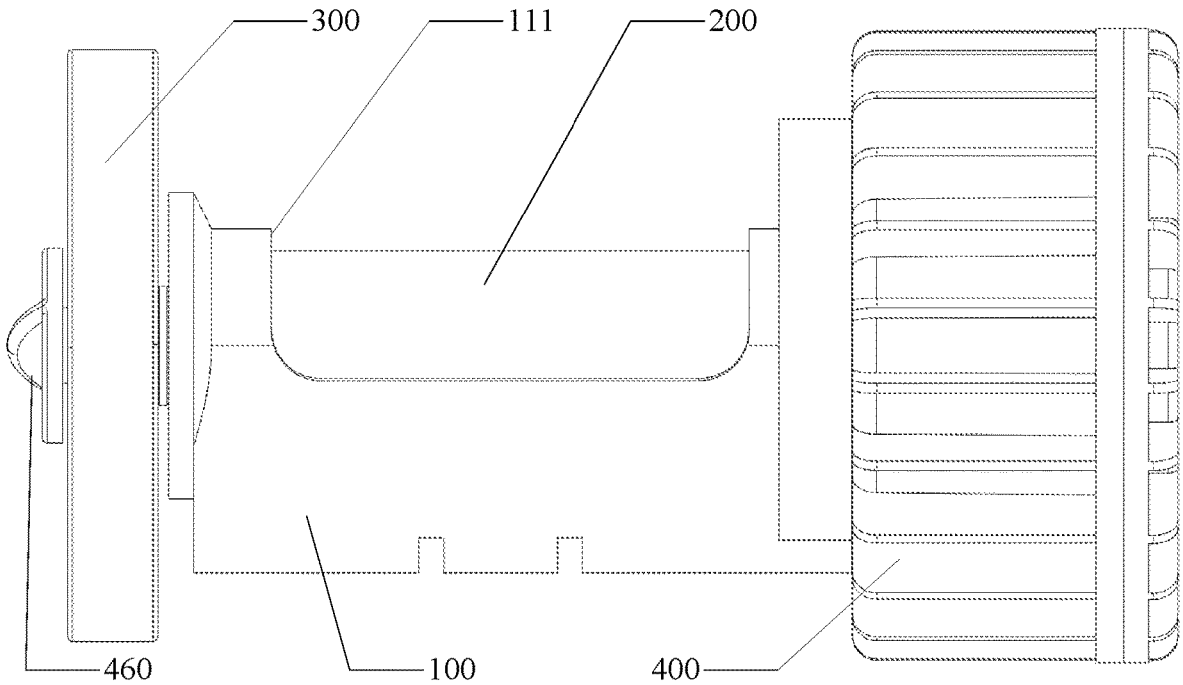
FIG. 1 is a structural diagram of a hydraulic damping device with adjustable resistance according to the present disclosure.

The present disclosure discloses a liquid damping device with adjustable resistance. As shown in FIG. 1, the liquid damping device with adjustable resistance includes a support frame 100, a rotating mechanism 200, a liquid damping mechanism 400 and an inertia wheel 300. The rotating mechanism 200 is arranged on the support frame 100, and both ends of the rotating mechanism 200 are respectively connected with the liquid damping mechanism 400 and the inertia wheel 300. Thus, a smooth resistance is provided for the hydraulic damping device with adjustable resistance.

Figure 2:
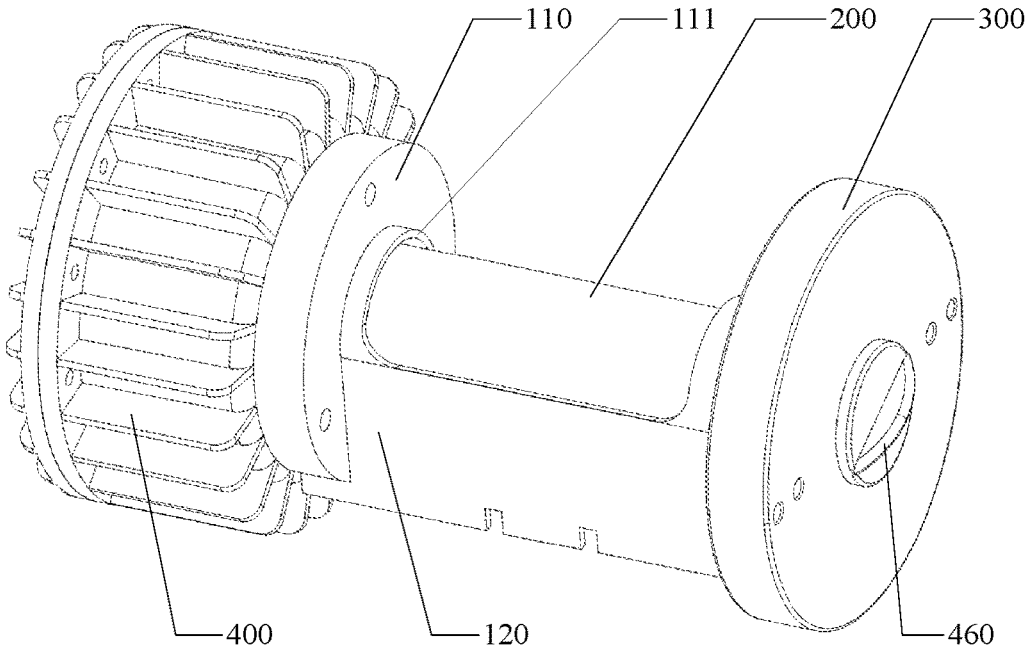
FIG. 2 is another structural diagram of the hydraulic damping device with adjustable resistance according to the present disclosure.
Figure 3:
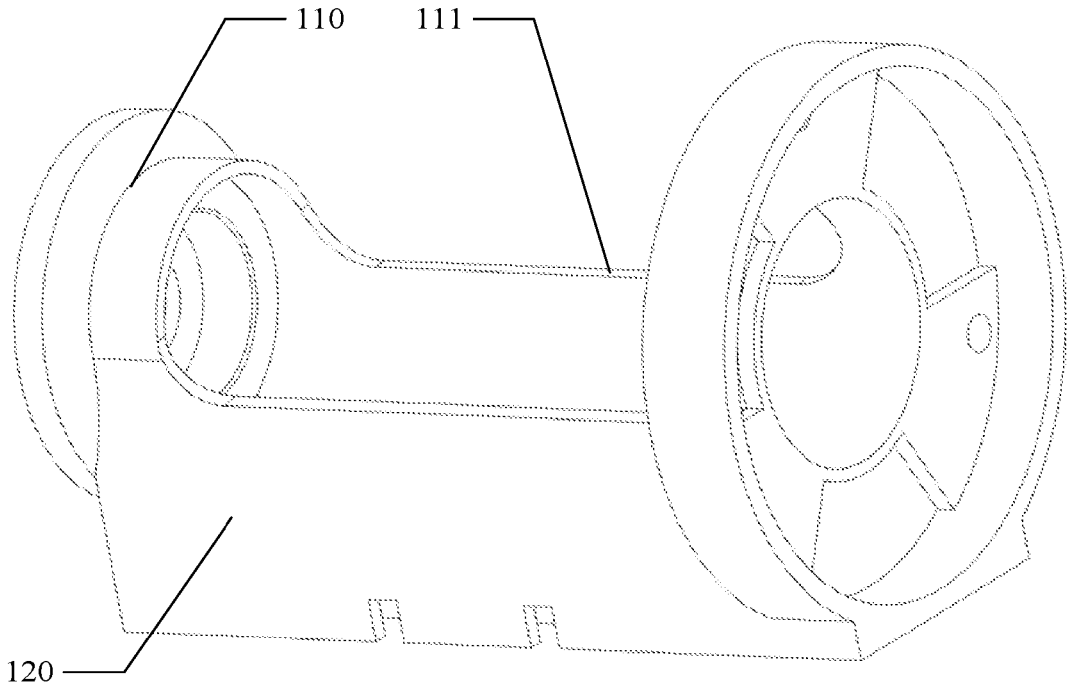
FIG. 3 is a structural diagram of a support frame according to the present disclosure.

As shown in FIGS. 2 and 3, the support frame 100 includes a loading frame 110 and a positioning frame 120, the loading frame 110 is configured to load the rotating mechanism 200. At least one opening 111 is also arranged on one side of the loading frame 110 corresponding to the rotating mechanism 200, and the opening 111 is used to connect external equipment with the rotating mechanism 200 to obtain the resistance of the hydraulic damping device with adjustable resistance. For example, the loading frame 110 is provided with a first opening and a second opening, and the rotating mechanism 200 is provided with a gear corresponding to a position of the first opening, and an anti-skid lines corresponding to a position of the second opening. When the liquid damping device with adjustable resistance is applied to the fitness equipment such as a rowing machine, the user may obtain resistance by connecting the rotating mechanism 200 with the first opening through a chain. When the liquid damping device with adjustable resistance is applied to the fitness equipment such as a riding platform, the resistance may be obtained by rotating the rotating mechanism 200 through a rotation friction of a rear tire while pressing the rear tire of the bicycle on the rotating mechanism 200 through the second opening. Therefore, a hydraulic damping device with adjustable resistance can be flexibly connected with different types of external equipment through a plurality of openings 111, to provide a wide range of applications for the hydraulic damping device with adjustable resistance. The opening 111 may also accelerate a heat dissipation speed of the rotating mechanism 200 to a certain extent. For example, when the rotating mechanism 200 rotates at high speed for a long time, a lot of heat is generated. The opening 111 can make the rotating mechanism 200 in continuous direct contact with outside air to cool down when the rotating mechanism 200 rotates.

As shown in FIG. 2, the positioning frame 120 can be connected with external items. For example, the positioning frame 120 can be connected with the ground and the wall, and the liquid damping device with adjustable resistance can also be connected with equipment of different structures through the positioning frame 120. For example, the liquid damping device with adjustable resistance can be connected with a frame having adjustable angle, so that the hydraulic damping device with adjustable resistance can be flexibly applied to different sites, such as bedrooms, factories and gyms, and can also be combined with equipment with different structures, such as cars, ships and sports equipment.

Figure 4:
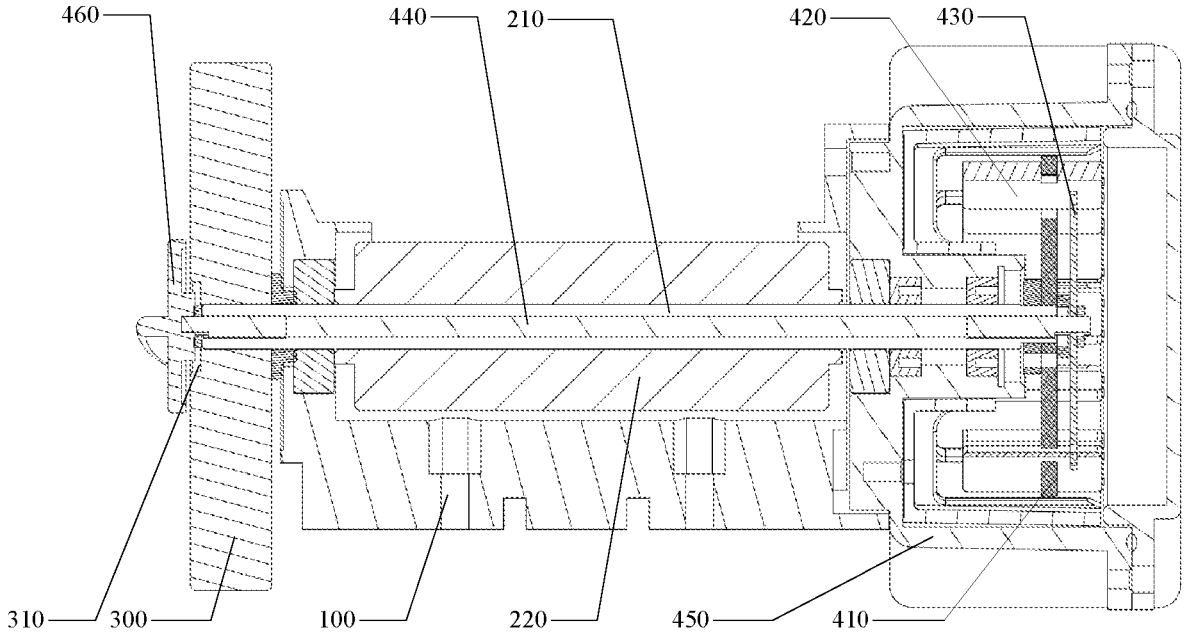
FIG. 4 is a sectional view of the hydraulic damping device with adjustable resistance according to the present disclosure.
Figure 5:
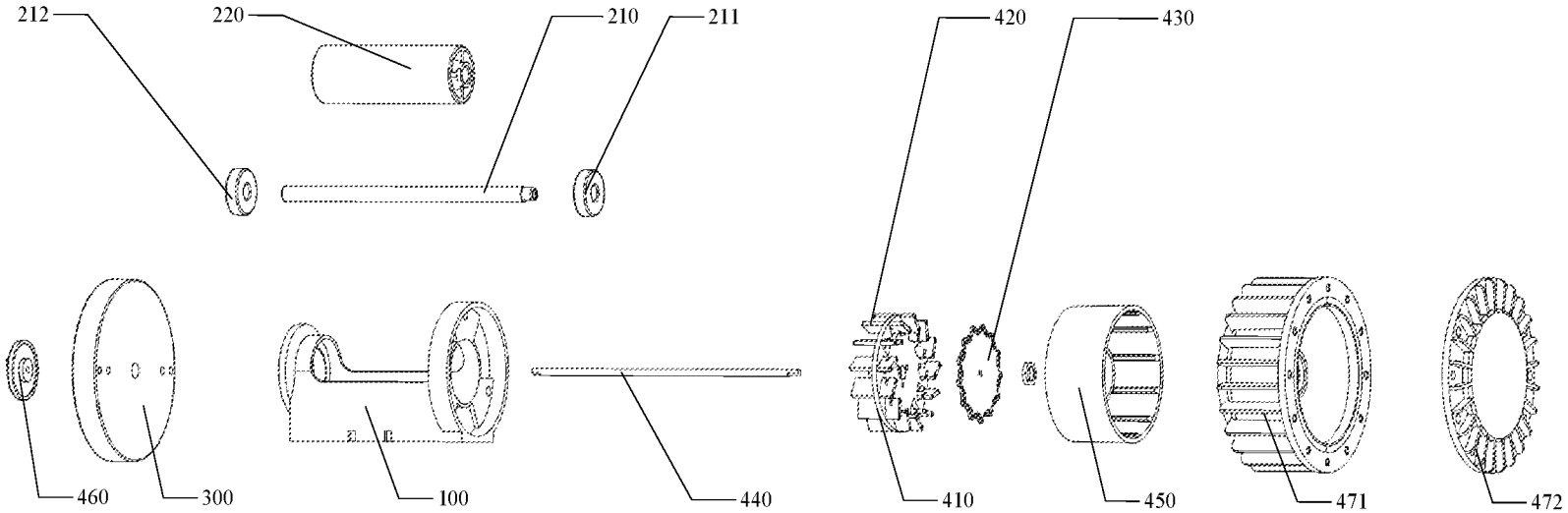
FIG. 5 is an exploded view of the hydraulic damping device with adjustable resistance according to the present disclosure.

As shown in FIGS. 4 and 5, a hydraulic damping mechanism includes a housing and a rotating disc 410. The housing may include a first housing 471 and a second housing 472 which are detachably connected with each other to facilitate the user to replace the damping fluid in the housing. The first housing 471 is connected to the loading frame 110. For example, the first housing 471 is provided with a protrusion towards the loading frame 110, the protrusion is adapted to an outer edge extending outward at one end of the loading frame 110, so that the protrusion can be clamped into the outer edge to realize the stable connection between the housing and the loading frame 110. Fins can be arranged outside the housing to dissipate heat, so that the liquid damping mechanism 400 can quickly cool down. The outside of the housing can also be coated with heat dissipation coating to speed up the heat dissipation.

Figure 6:
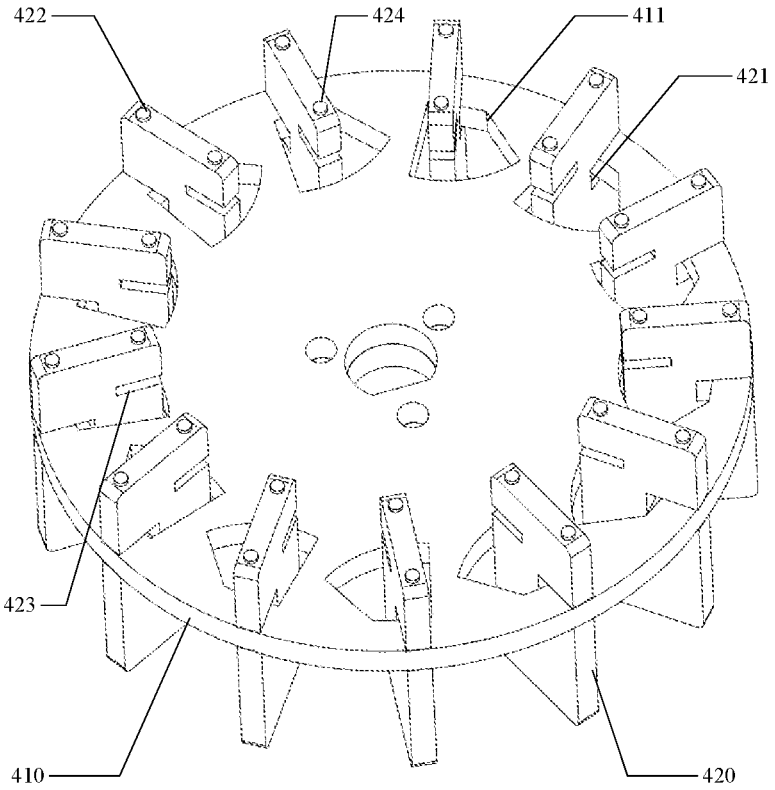
FIG. 6 is a structural diagram of a rotating disc provided with a blade according to the present disclosure.
Figure 7:
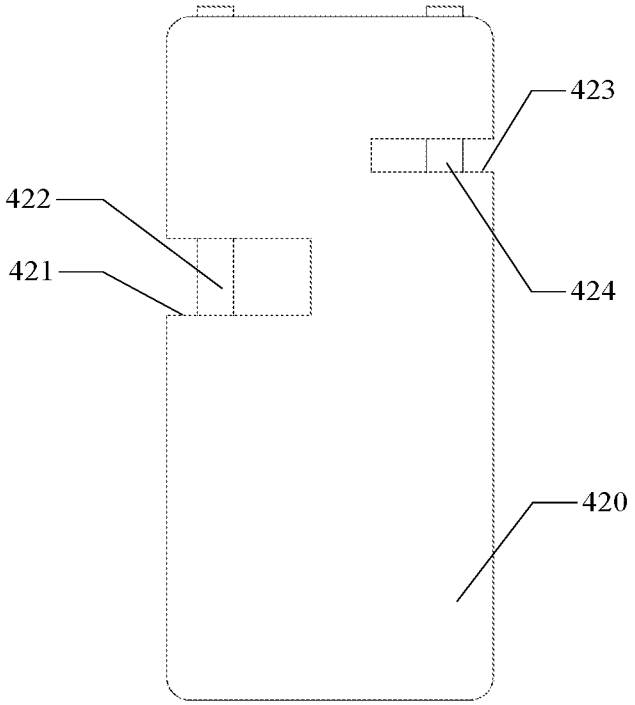
FIG. 7 is a structural diagram of the blade according to the present disclosure.

As shown in FIG. 4, the rotating disc 410 is connected with the rotating mechanism 200 extending into the housing so that the rotating disc 410 rotates synchronously with the rotating mechanism 200, therefore the resistance of the rotating disc 410 can be transmitted to the rotating mechanism 200 and then to external equipment through the rotating mechanism 200. As shown in FIG. 6 and FIG. 7, at least one blade 420 is arranged on the rotating disc 410. Therefore, when the rotating disc 410 drives the blade 420 to rotate, resistance is generated by disturbing the damping liquid in the housing. The damping liquid can be any substance with approximate flow properties, such as liquid, solid-liquid mixture, particles, etc. The blade 420 is connected with the rotating disc 410 in an adjustable angle. For example, a second socket 421 is arranged on one side of the blade 420, and a second positioning column 422 is also arranged at the position of the second socket 421 on the blade 420. The second positioning column 422 may extend into the second socket 421 to connect the blade 420 with the rotating disc 410, and place the edge of the rotating disc 410 into the second socket 421. The rotating blade 420 is fixed on the rotating disc 410 at a certain angle by fixing the blade 420 on the rotating disc 410 through the second positioning column 422. The user can also adjust the angle of the blade 420 relative to the rotating disc 410 according to the actual demand. Then, the blade 420 is fixed on the rotating disc 410 through the second positioning column 422, so that the blade 420 can be fixed at different angles relative to the rotating disc 410 to produce different resistance effects. It should be noted that the blade 420 can be any shape, for example, the shape of the blade 420 can be rectangular, elliptical, willow leaf and other shapes.

As shown in FIG. 6, a fan-shaped through hole 411 can be arranged on the rotating disc 410. The blade 420 is arranged in the fan-shaped through hole 411, so that the blade 420 rotates in a fixed track. For example, a radian of the fan-shaped through hole 411 is 40 degrees, and a radian scale is arranged at the position of the fan-shaped through hole 411. The user set the blade 420 to be corresponded to the radian scale at 30 degrees, and to be fixed on the rotating disc 410 with the second positioning column 422. Therefore, when adjusting the angle of the blade 420, the blade 420 can move according to the track of the fan-shaped through hole 411 and the angle of the blade 420 is adjusted efficiently and accurately. When the rotating disc 410 rotates, the fan-shaped through hole 411 is used to realize a smooth flow of the damping liquid in the housing, to accelerate the fluidity of the damping liquid and to increase the heat dissipation speed of the damping liquid.

Figure 8:
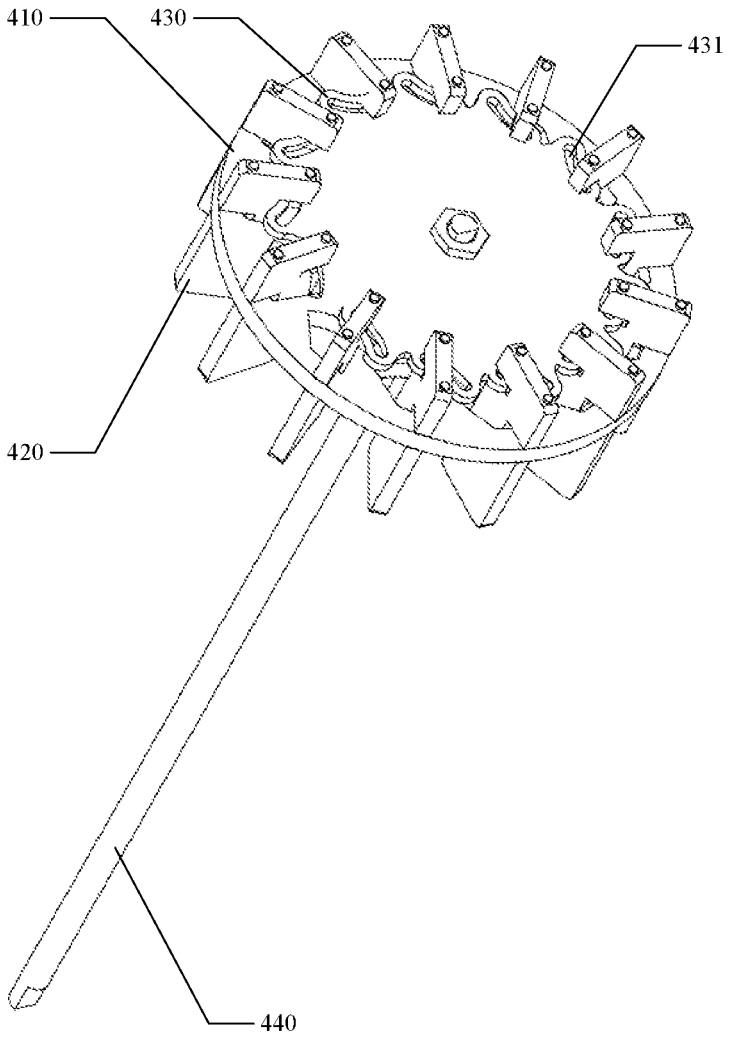
FIG. 8 is a structural diagram of the rotating disc, the steering disc and the steering rod according to the present disclosure.

As shown in FIG. 5 and FIG. 8, a steering disc 430 is arranged at the position corresponding to the rotating disc 410, and a slide path 431 is arranged on the steering disc 430. Therefore, when the steering disc 430 rotates, the blade 420 can be driven to rotate at an angular velocity to the rotating disc 410 through the cooperation of the slide path 431 and the slide rail 424 arranged on the blade 420. Thus, the magnitude of the interaction force between the damping fluid and the blade 420 can be adjusted. The rotating disc 410 can also drive a plurality of blades 420 to rotate at a uniform angle through rotation, so that the rotating disc 410 receives uniform resistance during rotation. For example, a plurality of fan-shaped through holes 411 are arranged radially on the rotating disc 410, and the blade 420 is arranged in the fan-shaped through hole 411 and inserted into the edge of the rotating disc 410 through the second socket 421. The blade 420 penetrates the second socket 421 and the rotating disc 410 through a third through hole arranged on the rotating disc 410 by the second positioning column 422, so that the blade can rotate freely in the axial direction. A steering disc 430 is also arranged above the rotating disc 410, a plurality of arc-shaped through holes (slide path 431) are arranged at the edge of the steering disc 430, and a first socket 423 is also arranged on the blade 420. The first socket 423 is cooperated with the edge of the steering disc 430 and passes through the first socket 423 and the steering disc 430 through the first positioning column (slide rail 424). Therefore the blade 420 can move along the track of the arc-shaped through hole (slide path 431), so that when the steering disc 430 rotates at a certain angular velocity to the rotating disc 410, the plurality of blades 420 rotate at a uniform angular velocity to the rotating disc 410.

As shown in FIG. 8, the steering wheel 430 is connected with the steering rod 440 so that the user can adjust the angle of the steering wheel 430 relative to the rotating disk 410 by rotating the steering rod 440, and the angle of the blade 420 relative to the rotating disk 410 can be adjusted to change the resistance between the damping fluid in the housing and the blade 420. For example, a steering rod 440 is arranged at the center of the steering wheel 430. When the steering rod 440 is rotated, the steering wheel 430 can rotate synchronously, thereby driving the blade 420 to rotate relative to the rotating disk 410.

Figure 9:
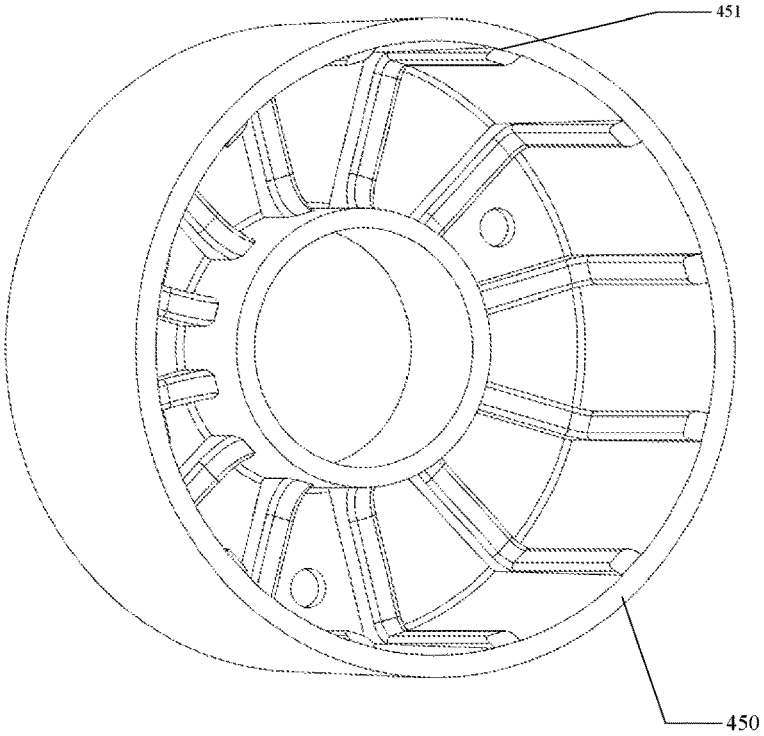
FIG. 9 is a structural diagram of a resistance sleeve of the present disclosure.

As shown in FIGS. 5 and 9, an inner side of the housing is also provided with a resistance sleeve 450. The resistance sleeve 450 is adapted to and detachably connected with the housing. For example, the resistance sleeve 450 is threaded and clamped with the housing, so as to facilitate the user to replace or maintain the resistance sleeve 450. A resistance rib 451 is arranged in the resistance sleeve 450. The resistance rib 451 can change the structural characteristics inside the housing and affect a flow mode of the damping liquid by cooperating with the blade 420 to produce different resistance effects. The resistance rib 451 can be a variety of structures, such as wave structure, spiral structure, etc., to produce resistance of different sizes. A composite material sheet or metal sheet with high thermal conductivity can also be arranged in the resistance rib 451 to accelerate the heat emission speed of the damping liquid.

As shown in FIG. 5, the rotating mechanism 200 is arranged on the support frame 100 to connect the liquid damping mechanism 400 with the inertia wheel 300, so as to realize a synchronous rotation of the inertia wheel 300 and the rotating disc 410 in the liquid damping mechanism 400 and to provide stable resistance. The rotating mechanism 200 may include a central shaft 210, a first rolling bearing 211 and a second rolling bearing 212. For example, the first rolling bearing 211 is arranged at one end of the loading frame 110, and the second rolling bearing 212 is arranged at the other end of the loading frame 110. The central shaft 210 is movably connected to the loading frame 110 through the first rolling bearing 211 and the second rolling bearing 212, so that the central shaft 210 can rotate smoothly.

As shown in FIG. 2 and FIG. 5, a sleeve 220 can also be sleeved on an outside of the central shaft 210. The central shaft 210 is used to connect with external equipment. For example, an anti-skid pattern to increase friction may be arranged on the outside of the sleeve 220, so that the external equipment can drive the sleeve 220 to rotate to obtain resistance, and to contact the rear tire of the bicycle with the sleeve 220. By riding the bicycle, the user can drive the sleeve 220 to rotate to produce a training effect and feeling of riding. A gear may be arranged on the outside of the sleeve 220. For example, the hydraulic damping mechanism with adjustable resistance may also be applied to a direct drive riding platform. The gear outside the sleeve 220 is connected with the riding platform through a chain to realize that the riding platform drives the rotating mechanism 200 to rotate through the chain to obtain resistance. Thus, the liquid damping device with adjustable resistance may be connected with external equipment through a variety of connection modes. The sleeve 220 can also be detachably connected with the shell of the central shaft 210 to facilitate the user to replace the sleeve 220 of different structural types to connect with different types of external equipment. The two ends of the sleeve 220 can also be provided with blades. Therefore, when the sleeve 220 rotates, the blades generate wind due to rotation, which can quickly discharge the heat in the support frame 100 and the rotating mechanism 200 for cooling. At the same time, the external equipment in contact or connected with the sleeve 220 may also be cooled. A hollow structure may be formed between the sleeve 220 and the central shaft 210 to facilitate heat dissipation of the central shaft 210.

As shown in FIG. 4 and FIG. 5, a cavity can also be arranged in the middle shaft 210 so that the steering rod 440 connected with the steering wheel 430 extends to one end of the inertia wheel 300 through the cavity, so that the user can rotate the steering rod 440 outside the hydraulic damping mechanism 400 to control the rotation of the steering wheel 430 relative to the rotating disk 410, that is, the resistance is controlled by controlling the angle of the blade 420 relative to the rotating disc 410. The operation method can be to manually rotate the steering rod 440 or connect with an external device to drive the rotating rod 440 to rotate. For example, the steering rod 440 is connected with a motor, which controls the rotation angle of the steering rod 440 to control the rotation of the steering disc 430.

As shown in FIG. 2 and FIG. 5, a rotating button 460 is also arranged at one end of the steering rod 440 extending beyond the hydraulic damping mechanism 400. The rotating button 460 is connected with the steering rod 440. By rotating the rotating button 460, the steering rod 440 can be driven to rotate, which is convenient for the user to adjust the resistance. A groove 310 is arranged on the inertia wheel 300 connected with the rotating mechanism. The rotating button 460 is clamped into the groove 310 and can be rotated relative to the groove 310. Therefore, the rotating button 460 is connected to the steering rod 440 while clamped into the groove 310, the steering rod 440 is driven by the rotating button to rotate synchronously with respect to the central shaft 210, which will not scratch and collide with the cavity due to centripetal force, so as to ensure safety. The outside of the rotating button 460 can be provided with anti-skid lines to increase the friction force when the user rotates the rotating button 460. The cavity can also help to dissipate the heat in the liquid damping mechanism 400.

As shown in FIG. 5, the inertia wheel 300 is detachably connected with the rotating mechanism 200 to facilitate the user to replace the inertia wheel 300 with different masses and provide different inertia forces for the hydraulic damping device with adjustable resistance. Scales, such as angle scale and resistance scale, can also be set around the groove 310 on the inertia wheel 300, so that the user can obtain the corresponding resistance effect and convenient experience by turning the rotating button 460 to different scales.

Figure 10:
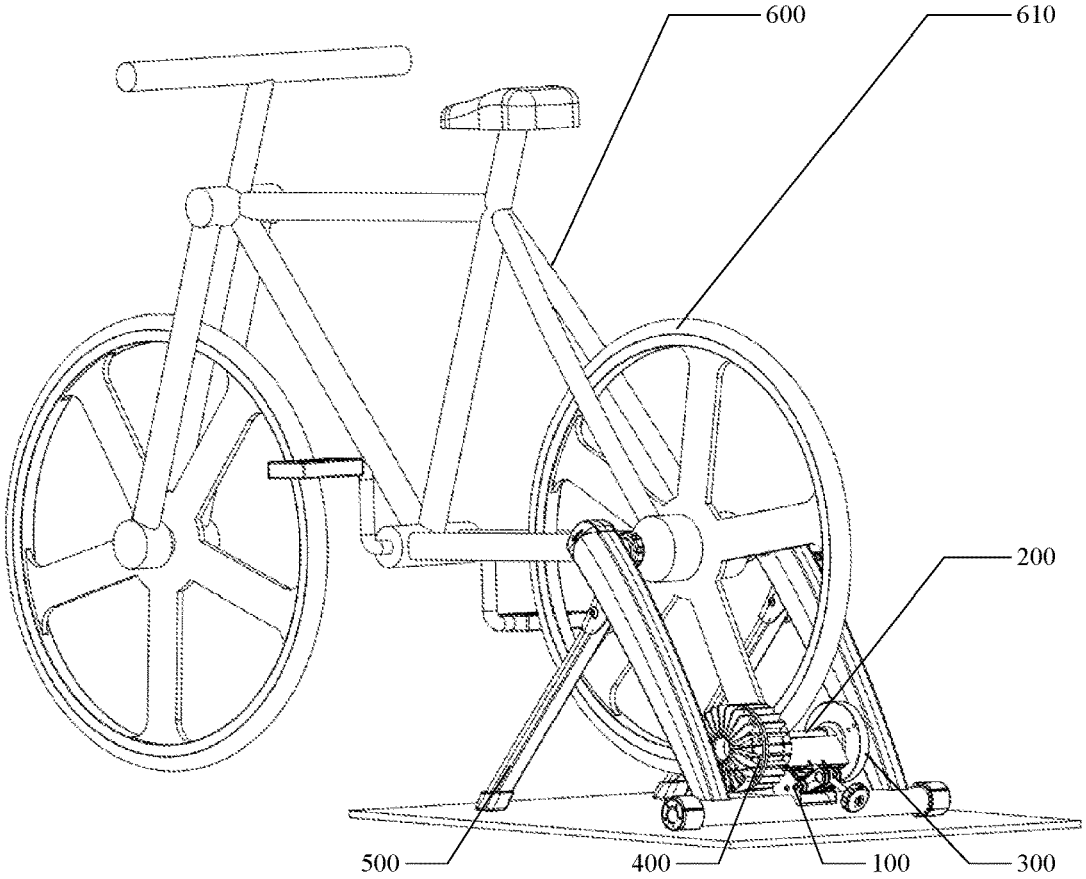
FIG. 10 is a structural diagram of a riding platform according to an embodiment of the present disclosure.

The present disclosure also discloses a riding platform, as shown in FIG. 10. The riding platform includes the above-mentioned liquid damping device with adjustable resistance. The structural features and technical effects are described above, which will not be repeated here. When using the riding platform, the user may fix the liquid damping device with adjustable resistance on the frame 500 through the positioning frame 120, to keep the hydraulic damping device with adjustable resistance stable. The rear tire 610 of a bicycle 600 is contacted with the rotating mechanism 200 of the hydraulic damping device with adjustable resistance through the opening 111. When the user rides the bicycle 600, the rear tire 610 of the bicycle 600 rubs the rotating mechanism 200 to drive the rotating disc 410 provided with the blade 420 to rotate, so as to obtain a smooth resistance effect close to riding. By adjusting the angle of the blade 420 relative to the rotating disc 410, the user may adjust the rotating button 460 according to his own situation so as to obtain a suitable resistance effect when riding and meet the personalized needs of the user.

The hydraulic damping device with adjustable resistance according to the present disclosure is described below with an embodiment.

As shown in FIG. 2, a hydraulic damping device with adjustable resistance includes a support frame 100, the support frame 100 includes a positioning frame 120 and a loading frame 110, the loading frame 110 has a tubular structure, and the outer edge extending outward at one end of the loading frame 110 is adapted to a protrusion arranged on the housing of the hydraulic damping mechanism 400, so that the positioning frame 120 is firmly connected with the housing. The rotating mechanism 200 includes a central shaft 210, a first rolling bearing 211 and a second rolling bearing 212. The central shaft 210 is movably connected to the loading frame 110 through the first rolling bearing 211 and the second rolling bearing 212, so that the central shaft 210 can rotate with low friction. The outer side of the central shaft 210 is provided with a sleeve 220, and the sleeve 220 is provided with anti-skid lines to contact the rear tire 610 of bicycle and increase the stability of friction between the rear tire 610 of bicycle and the sleeve 220.

As shown in FIG. 6, a rotating disc 410 is arranged in the housing, and the rotating disc 410 is connected with the central shaft 210. Therefore, when the central shaft 210 is driven by external equipment, the rotating disc 410 can rotate synchronously with the central shaft 210. A plurality of fan-shaped through holes 411 are arranged radially on the rotating disc 410, and each fan-shaped through hole 411 is provided with a blade 420. One end of the blade 420 is provided with a second socket 421. The blade 420 is inserted into the edge of the rotating disc 410 through the second socket 421, and then movably connected with the rotating disc 410 through a second positioning column 422 arranged on the blade 420. Therefore the blade 420 can rotate freely in the fan-shaped through hole 411.

As shown in FIG. 6 and FIG. 8, a steering disc 430 is arranged above the rotating disc 410, and an arc-shaped through hole (slide path 431) is arranged on the steering disc 430 corresponding to the blade 420. The blade 420 is inserted into the edge of the steering disc 430 through a first socket 423 and into the arc-shaped through hole (slide path 431) through a first positioning column (slide rail 424). When the steering disc 430 rotates relative to the rotating disc 410, a plurality of blades 420 can be driven to rotate at the same angular velocity to the rotating disc 410. A resistance sleeve 450 is also clamped on the inner side of the housing, and a strip resistance rib 451 is arranged in the resistance sleeve to cooperate with the blade 420 to interact with the damping liquid in the housing to generate resistance.

As shown in FIG. 8, a steering rod 440 is connected with the steering wheel 430 through bolts and extends out of the hydraulic damping mechanism 400 through a cavity arranged in the central shaft 210. A rotating button 460 is also arranged at the end of the steering rod 440 extending out of the central shaft 210, which is used to rotate the steering rod 440 to control the resistance. When the inertia wheel 300 rotates synchronously with the rotating disc 410, the rotating button 460 is placed in the groove 310 arranged on the inertia wheel 300, so as to ensure that the steering rod 440 rotates synchronously with respect to the central shaft 210 when the rotating disc 410 rotates, that is, the blade 420 remains at a fixed angle with respect to the rotating disc 410 to ensure that the resistance remains unchanged. When the user needs to adjust the resistance, the user adjusts the angle of the blade 420 relative to the rotating disc 410 to adjust the resistance by rotating the rotating button 460.

To sum up, the present disclosure discloses a liquid damping device with adjustable resistance, including a support frame 100, a rotating mechanism 200, a liquid damping mechanism 400 and an inertia wheel 300. The rotating mechanism 200 is arranged on the support frame 100, and the liquid damping mechanism 400 and the inertia wheel 300 are respectively arranged at both ends of the rotating mechanism 200. The rotating mechanism 200 includes a central shaft 210, a first rolling bearing 211 and a second rolling bearing 212. The central shaft 210 is movably connected to the support frame 100 through the first rolling bearing 211 and the second rolling bearing 212. Therefore, the central shaft 210 can rotate stably. The central shaft 210 is provided with a cavity to speed up the discharge of heat in the liquid damping mechanism 400 and the rotating mechanism 200. The outer side of the central shaft 210 can be provided with a sleeve 220 used to connect with external equipment to realize the connection of the hydraulic damping device with adjustable resistance with various types of external equipment. The hydraulic damping mechanism 400 includes a housing and a rotating disc 410. The rotating disc 410 is provided with a blade 420, and the angle of the blade 420 relative to the rotating disc 410 can be adjusted. Therefore, during the rotation of the rotating disc 410, the damping fluid in the housing provides different resistance to the blade 420 with different angles relative to the rotating disc 410. A plurality of fan-shaped through holes 411 are arranged on the rotating disc 410 so that the blade 420 can rotate along the fan-shaped through hole 411 in a fixed track. The hydraulic damping mechanism 400 also includes a steering disc 430, which is arranged at a corresponding position of the rotating disc 410. a slide path 431 is arranged on the steering disc 430, and the slide path 431 is adapted to the slide rail 424 arranged on the blade 420. Therefore, when one end of the blade 420 is movably connected with the rotating disc 410, and the steering disc 430 rotates relative to the rotating disc 410, the plurality of blades 420 can rotate at a certain angular velocity through the cooperation between the slide path 431 and the slide rail 424, so as to control the resistance between the rotating disc 410 and the damping liquid. A steering rod 440 is arranged on the steering wheel 430. The steering rod 440 can control the rotation of the steering wheel 430, so as to drive a plurality of blades 420 to rotate at a uniform angular velocity, so that the rotating disk 410 is subject to uniform and smooth resistance. The steering rod 440 may extend to one side of the inertia wheel 300 through the cavity arranged in the central shaft 210, for the user to control the angle of the blade 420 relative to the rotating disc 410 from the outside of the hydraulic damping mechanism 400. One end of the steering rod 440 toward the inertia wheel 300 is also provided with a rotating button 460. When the rotating disc 410 rotates, the rotating button 460 may be fixed on the inertia wheel 300 to ensure that the rotating button 460 rotates synchronously with the inertia wheel 300, that is, to ensure that the angle of the steering disc 430 relative to the rotating disc 410 is fixed. A groove 310 is arranged on the inertia wheel 300 to hold the rotating button 460 to ensure that when the rotating button 460 rotates synchronously with the inertia wheel 300, the rotating button 460 is not contacted by external items, thus the safe operation of the hydraulic damping device with adjustable resistance is assured.

It should be understood that the application of the present disclosure is not limited to the above embodiments. For those skilled in the art, it can be improved or transformed according to the above description. All these improvements and transformations should belong to the protection scope of the appended claims of the present disclosure.

What is claimed is:

1. A hydraulic damping device with adjustable resistance, comprising: a support frame, a rotating mechanism movably connected to the support frame, a hydraulic damping mechanism arranged at one end of the rotating mechanism and an inertia wheel detachably connected to an other end of the rotating mechanism, wherein the hydraulic damping mechanism comprises:

a shell; and a rotating disc connected with the rotating mechanism extending into the shell, at least one blade being arranged on the rotating disc, wherein the blade includes a first end and a second end, the first end being positioned closer to a center of the rotating disc than the second end, and the blade being pivotable about the second end, and wherein the first end of the blade is movable between a first position and a second position by a pivot movement of the blade, thereby adjusting an angle of the blade to provide resistance at a corresponding angle.

2. The hydraulic damping device with adjustable resistance according to claim 1, further comprising:

a steering wheel arranged at a position corresponding to the rotating disk in the shell, and a slide path is arranged at a position corresponding to a slide rail of the blade;

a steering rod connected with the rotating disc to control a resistance through the steering rod.

3. The hydraulic damping device with adjustable resistance according to claim 2, wherein the rotating disc is provided with a fan-shaped through hole, and the blade is arranged in the fan-shaped through hole.

4. The hydraulic damping device with adjustable resistance according to claim 3, wherein the slide path is an arc-shaped through hole, and the slide rail is a first positioning column.

5. The hydraulic damping device with adjustable resistance according to claim 4, wherein a cavity is arranged in the rotating mechanism, and the steering rod extends to the other end of the rotating mechanism through the cavity.

6. The hydraulic damping device with adjustable resistance according to claim 5, further comprising a rotating button connected with the steering rod, wherein a groove is arranged on the inertia wheel corresponding to a position of the rotating button, and the rotating button is clamped in the groove.

7. The hydraulic damping device with adjustable resistance according to claim 6, wherein a resistance sleeve is detachably connected in the shell, and a resistance rib is arranged on an inner side of the resistance sleeve.

8. The hydraulic damping device with adjustable resistance according to claim 7, wherein an opening is arranged on the support frame relative to one side of the rotating mechanism.

9. A riding platform, wherein a hydraulic damping device with adjustable resistance is arranged in the riding platform, the hydraulic damping device with adjustable resistance comprises a support frame, a rotating mechanism movably connected to the support frame, a hydraulic damping mechanism arranged at one end of the rotating mechanism and an inertia wheel detachably connected to the another end of the rotating mechanism;

wherein the hydraulic damping mechanism comprises:

a shell; and a rotating disc connected with the rotating mechanism extending into the shell, at least one blade is arranged on the rotating disc, wherein the blade includes a first end and a second end, the first end being positioned closer to a center of the rotating disc than the second end, and the blade being pivotable about the second end, and wherein the first end of the blade is movable between a first position and a second position by a pivot movement of the blade, thereby adjusting an angle of the blade to provide resistance at a corresponding angle.

* * * * *